United States Patent [19]

Moore

[11] 4,399,978

[45] Aug. 23, 1983

[54] HAND TOOL WITH VARIABLE INCLINED HEAD

[76] Inventor: Charles H. Moore, R.R. 4, Robinson, Ill. 62454

[21] Appl. No.: 352,810

[22] Filed: Feb. 26, 1982

[51] Int. Cl.[3] ..... B25C 11/00

[52] U.S. Cl. ..... 254/26 R; 145/2 R; 145/29 R

[58] Field of Search ..... 254/26 R, 27; 145/29 R, 145/2 R, 2 A

[56] References Cited

U.S. PATENT DOCUMENTS

| | | | |
|---|---|---|---|
| 213,646 | 3/1879 | Fix | 145/2 R |
| 319,294 | 6/1885 | Millspaugh | 145/2 R |
| 821,155 | 5/1906 | Carlton et al. | 145/29 R |
| 850,024 | 4/1907 | Lewis | 145/29 R |
| 981,786 | 1/1911 | Montgomery | 145/2 R |
| 1,821,041 | 9/1931 | Turner | 254/27 |
| 1,822,280 | 9/1931 | Ervay | 254/26 |
| 1,895,342 | 1/1933 | Pelton et al. | 145/2 R |

FOREIGN PATENT DOCUMENTS

| | | | |
|---|---|---|---|
| 659580 | 2/1929 | France | 145/2 R |

*Primary Examiner*—Frederick R. Schmidt
*Assistant Examiner*—J. Zatarga
*Attorney, Agent, or Firm*—Emrich, Lee, Brown & Hill

[57] ABSTRACT

A small hand tool such as a carpenter's hammer is disclosed as having a head which is pivotally connected crosswise to its handle. The head is provided with abutment faces which at different inclinations of the head to the handle are selectively aligned with the blunt end of a latch rod threadedly connected to the handle within a provided axially extending bore. Rotation of a larger-sized operating knob at the rearward end of the handle effectively advances and retracts the latch rod to releasably lock the hammer head to the handle in the selected position to which it is adjustable thereon.

1 Claim, 6 Drawing Figures

HAND TOOL WITH VARIABLE INCLINED HEAD

This invention relates to hand tools such as a carpenter's hammer, pinch bar, or pry and the like having a head which can be variably inclined to its handle and so increase the versatility of the tool.

In the conventional carpenter's hammer, its tool head comprises a solid metal body set crosswise of the handle to which it is rigidly fixed. Commonly the head will comprise a first projecting portion set at right angles to the handle of the hammer and having a nail driving or pounding end face. It will also comprise a second portion which projects to the opposite side of the hammer. This second portion is usually shaped as a claw or is slotted for use in pulling nails.

U.S. Pat. No. 1,822,280 illustrates a carpenter's hammer in which the head is provided with a spring-biased detent or wedge which engages in appropriately located notches in the shank of the handle to releasably lock the hammer head to the handle in each of several positions to which it can be inclined. U.S. Pat. No. 930,545 illustrates a tack hammer provided with a sleeve which slides over the bifurcated end of the hammer handle to capture the hammer head when its claw portion is in line with the handle or to capture a lug which enters the bifurcated end when the hammer head is set at right angles to the handle. In a third U.S. Pat. No. 850,024 the handle of a silversmith's hammer encloses a rod connected at one end to the hammer head in offset relation to the pivotal connection of the hammer head to the handle. The other end of the rod is threadedly connected to a thumb piece which is rotatably held in the rearward end of the hammer handle whereby rotation of the thumb piece effectively swings the hammer head on its pivotal connection to the handle.

A principal object of this invention is to provide novel and improved means for releasably locking the head of such a hammer or other small hand tool in each of several positions to which the tool head can be advantageously inclined.

A further and more specific object of the invention is to provide a tool having an adjustable-position head which is easily operated and is also uncomplicated to make.

As afterwards more particularly described, in accordance with this invention, the handle of a hammer, pry, or other small hand tool contains a longitudinally-extending through-bore in which is threadedly connected a rigid latch rod having a flat or blunted forward end. The rod is advanceable on its threaded connection to the tool handle into the open space between the spaced hinge ears of the tool handle to which the tool head is pinned. The pinned attachment portion of the tool head has locating "flats" or abutment faces which selectively align with the flat or blunted end of the latch rod in each of the several positions to which the tool head is inclinable.

At the rear end of the handle is a knob by means of which the rod can be turned on its threaded connection to advance or tighten its forward end against the locating "flat" of the tool head so to lock the head in its inclined position to the handle. With reverse rotation of the knob the latch rod is readily retracted to permit readjustment of the tool head inclination to its handle.

An important feature of the invention is the positive locking of the tool head to the handle which is achievable in each of the selected positions to which the head of the tool is adjustable thereon.

A companion feature of the invention is the ease with which the lock can be relieved as when it is necessary to change the head inclination of the tool.

This capability is significant e.g. in a small hand tool such as a carpenter's hammer where the locking of the tool head to its handle must be capable of resisting and be unaffected by pounding and/or pulling forces which are exerted on or by the hammer in its normal use.

In a tool according to this invention such a capability is afforded by the number and forward location of the threads which comprise the connection of the latch rod to the tool handle whereas the rearward location of the larger-diameter size of the operating knob facilitates rotation of the latch rod on its connection to the handle both to tighten its blunted end against the similarly-shaped tool head locating faces or abutments.

Still another feature of the invention is the resistance which the operating knob provides to prevent accidental slippage of the hammer from the user's grip in his use of the tool as a hammer.

Many other objects as well as advantages and features of the invention will be apparent or will become so upon consideration of the presently preferred embodiment of the invention which now will be described.

Referring therefor to the accompanying drawing wherein like parts are identified by like reference numerals:

Figures 1, 2, 3, 4, 5, 6:
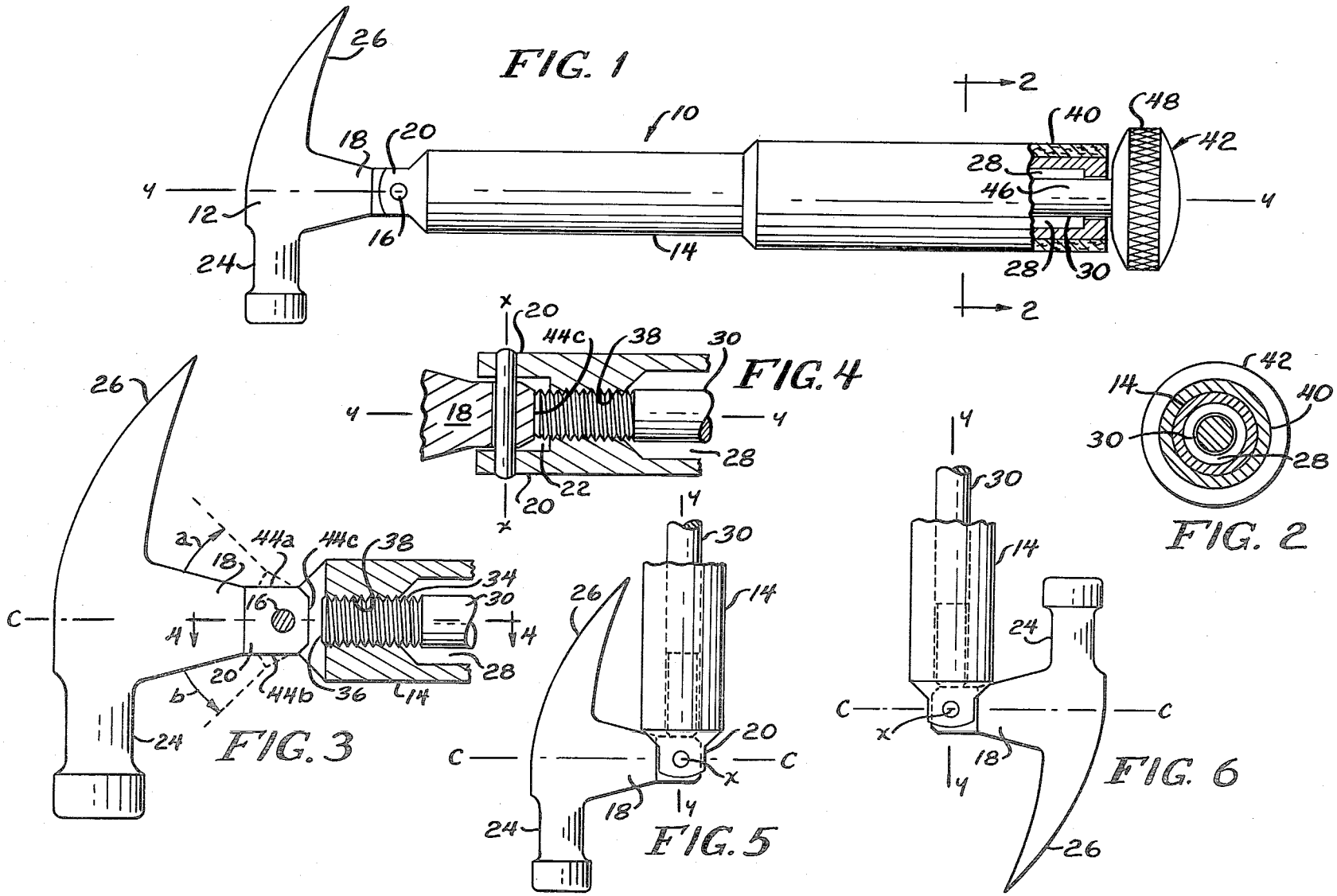
FIG. 1 is a side elevational view of a carpenter's hammer embodying the invention, a portion of the rear end of the hammer being cut away to show details of the mounting of the operating knob to the latch rod.
FIG. 2 is a cross sectional view taken along lines 2—2 in FIG. 1, looking in the direction indicated by the arrows.
FIG. 3 is a fragmented view of the forward end of the hammer illustrated by FIG. 1, the view being shown on a larger scale, with parts cut away to show the latch rod in its retracted position.
FIG. 4 is a sectional view taken along lines 4—4 of FIG. 3 and shows the latch rod advanced to lock the hammer head in its normal inclination to the hammer handle.

FIG. 5 is a fragmented view generally similar to FIG. 1, and shows the hammer head turned 90° clockwise from its normal position and locked to the handle for hammering in areas that are narrow or otherwise restrict the user's full swing of the hammer; and FIG. 6 is a view generally similar to FIG. 5, showing the hammer turned 90° counterclockwise from the showing in FIG. 1 and locked in position for use of the tool as a pry bar.

Referring now more particularly to the several figures which comprise the drawing and first to FIG. 1, the invention is shown embodied in a carpenter's hammer 10 having a hammer head 12 and an elongate handle 14 to which the hammer head is pivotally connected as by a pin 16.

Considering also FIGS. 3 and 4, it will be understood that the head 12 comprises a solid metal body which is of generally T-shape, its stem or trunk comprising an attachment portion 18 which extends into the space 20 between the hinge ear 22 on the forward end of the handle 14 to which the hammer head is pivotally connected by the aforementioned pin 16.

The head 12 of the illustrated hammer is shown comprising a solid butt portion 24 used in pounding and a claw or slotted portion 26 which is useful as a pry or for pulling nails. Said head portions 24 and 26 project from opposite sides of the attachment portion 18 and generally crosswise thereof. In the normal arrangement of the hammer components, the head is disposed generally at right angles to the axis y—y of the hammer handle as illustrated by FIG. 1. In other tools to which the invention is applicable, one or both portions 24 and 26 of the tool head may be differently sized and/or differently shaped. For example, one or both of their head portions may be wedge-like or ball-shaped.

Handle 14 is constructed of a suitably durable or rigid material such as steel or other metal; and as shown is tubular or cylindrical in cross-section. It however may also be oval or rectangular in cross-section. Preferably, handle 14 will have an appropriately-shaped hand grip portion 40 which surrounds and is fixed to the rearward portion of the hammer handle.

In accordance with this invention, handle 14 contains a longitudinally extending axially-disposed, through-bore 28 which opens through the forward and rearward ends of the handle. Operable within said bore 28 is a latch rod 30 having a threaded intermediate portion 34 shown disposed immediately behind its forward end 36 which enters space 22 between the handle hinge ears 20 in response to forward advancement of the latch rod. The rearward end of the latch rod 30 extends through the open rear end of the handle bore 28 and is fixedly connected to an externally-accessible operating knob 42.

A feature of the invention is that the forward end 36 of the latch rod has an essentially flat or planar end surface which is disposed normal to the longitudinal axis of the latch rod 30 and through-bore 28 in which said rod advances and retracts. Also, as shown in FIGS. 3 and 4, attachment portion 18 of the tool head 12 is formed with three similarly-sized and complementing shaped abutment faces or flats 44. These are arranged equidistantly about axis x—x of pin 16 and angularly spaced 90° apart.

It will thus be appreciated that when latch rod 30 has been retracted inwardly of bore 28, the hammer head 12 is free to rotate on pin 16. FIGS. 1, 3 and 4 illustrate the hammer head in its normal postion with its abutment flat or face **44*c* centered with the planar or blunted end 36 of the latch rod. By tightening the latch rod on its threaded connection 34 to threaded portion 38 of the handle, its end 36 is tightened into a wide area contact with the aligned face 44*c*. This effectively locks the hammer head in its normal inclination. The location of said thread immediately behind said engagement with the abutment face 44 enhances the locking of the hammer head and its resistance to breakdown in use of the tool. In the position illustrated by FIG. 1**, the tool operates essentially as a conventional hammer.

In the event that the user encounters a nail or other object to be pounded which is so located that there is insufficient room for the workman to swing the hammer, its tool head can be adjusted to the position illustrated by FIG. 5. This is readily accomplished by rotating knob 42 to retract the latch rod and free its end 36 from abutment flat **44*c*. The hammer head 12 is then free to be swung in the direction indicated by arrow a into the position illustrated by FIG. 5 in which position, abutment flat 44*a* aligns with the blunted end 36 of the latch rod. Knob 42 may be then rotated in reverse to tighten the latch rod on its threaded connection to the handle bore and its end 36 against abutment 44*a***.

In the event that the workman has need for a pry bar, again with rotation of the knob 42, he can retract the latch rod into the through-bore 28 so as to free its end 36 from abutment **44*c* or 44*a*, as the case may be, and swing the hammer head in the opposite direction indicated by arrow b to locate abutment 44*b* in alignment with end 36 of the latch rod. The rod is then retightened by reverse rotation of the knob 42**.

It will be appreciated that the number and size of the threads can be varied in accordance with the contemplated use of the tool. However, as illustrated, the threaded section 34 of the latch rods is most satisfactorily located behind its blunted end 36 and the threaded section 38 of the handle bore is located close to the open forward end thereof. The threaded connection of the latch rod to the handle is thereby located in a stable position close to the aligned abutment face 44 of the head attachment portion 18 where it is best able to cope with forces tending to be destructive of the locked assembly of the tool head 12 to the handle 14 and its latch rod 30.

Also, as illustrated in FIG. 1, preferably the rotating knob 42 is knurled as illustrated at 48 for convenience in its operation. The knob also has a diameter which is substantially greater than the corresponding dimensions of the hand grip portion 40 so that it protrudes therearound. This larger size of the knob 42 not only facilitates the locking and relieving of the latch rod to the aligned abutment face 44, but it also introduces a safety feature. Namely, the knob acts as a stop which inhibits accidental slippage of the hammer from the Examiner's grip in use. Any suitable means for securing the operating knob 42 to the rearward end of the latch rod 30 may be utilized. For example, it may be formed integral therewith or welded thereto. It also may be pinned or held in place by a set screw as is conventional.

Although the provision of three abutment flats or faces as illustrated by **44*c*, 44*a*, and 44*b*** has been found most satisfactory, it will be appreciated that the number of abutment faces could be increased beyond three or reduced to two, the number and angular displacement of said abutment faces being a function of the requirements of the tool.

Thus having described my invention, I claim:

1. In a carpenter's hammer or like small hand tool having an elongate handle and a tool head mounted crosswise of the handle, the improvement wherein the tool head embodies an intermediate attachment portion of rigid metal having a pair of work portions projecting laterally from opposite sides of the attachment portion, one of said work portions being a solid butt useful in pounding;

the elongate handle being of rigid metal and containing a longitudinally extending, axially-centered through-bore which opens through both the forward and rearward ends of the handle;

a pair of parallel spaced hinge ears integral with and projecting axially of the forward end of the handle;

the rearward end of said tool head attachment portion disposed in said space between the hinge ears; and a pivot pin pivotally connecting said attachment portion to the hinge ears, the axis of said pivot pin intersecting the longitudinal axis of said tool head attachment portion and said handle through-bore at right angles thereto;

the surrounding periphery of the tool head attachment portion embodying first, second and third planar abutment faces circumferentially spaced about said axis of the pivot pin and radially spaced equidistantly from said pivot pin axis at a distance less than the separation of the pivot pin from the forward end of the elongate handle;

the through-bore of the elongate handle having a circumferentially threaded wall portion immediately behind the forward end of the elongate handle;

a rigid metal latch rod in said handle through-bore extending axially thereof;

said rod having a planar forward end disposed normal to the axis of said rod and an exteriorly threaded portion by which it is threadedly connected to the handle, said externally threaded portion of the latch rod being disposed immediately behind its forward end;

a hand grip portion fixed to and surrounding the rearward end of said elongate handle for manual grasp in use of the tool;

an externally accessible knob operatively connected to the rearward end of the latch rod beyond the handle and its hand grip portion such that when rotated in one direction the forward planar abutment end of the latch rod is drawn into the forward end of the handle bore freeing the tool head to swing on the pivot pin and when rotated in the counter direction is moved outwardly therefrom into the space between the handle hinge ears so as to positively engage that one of the abutment faces of the tool head attachment portion aligned therewith and to lock the tool head to the handle;

the threaded forward portion of the latch rod having an axial length greater than that of the threaded portion of the handle such that the latch rod remains connected to the handle both when its forward end is fully retracted into the through bore of the handle and when expanded to engage with a selected one of the abutment faces of the tool head attachment portion aligned with the axis of the through-bore;

said knob having a diameter greater than that of the elongate handle such that the tool head can be positively locked both in the positions to which the tool head is adjusted on its hinged connection to the elongate handle and to prevent slippage of the user's grip on the tool in his use thereof.

* * * * *